US011066213B2

(12) United States Patent
Lin

(10) Patent No.: US 11,066,213 B2
(45) Date of Patent: Jul. 20, 2021

(54) CONTAINER LID

(71) Applicant: XIAMEN DEGUAN TECHNOLOGY CO., LTD., Xiamen (CN)

(72) Inventor: Manfan Lin, Xiamen (CN)

(73) Assignee: XIAMEN DEGUAN TECHNOLOGY CO., LTD., Xiamen (CN)

( * ) Notice: Subject to any disclaimer, the term of this patent is extended or adjusted under 35 U.S.C. 154(b) by 149 days.

(21) Appl. No.: 16/468,686

(22) PCT Filed: Sep. 30, 2018

(86) PCT No.: PCT/CN2018/109024

§ 371 (c)(1),
(2) Date: Jun. 12, 2019

(87) PCT Pub. No.: WO2020/037788

PCT Pub. Date: Feb. 27, 2020

(65) Prior Publication Data

US 2021/0002033 A1 Jan. 7, 2021

(30) Foreign Application Priority Data

Aug. 24, 2018 (CN) ..... 201810973938.X

(51) Int. Cl.

| | |
|---|---|
| ***B65D 21/02*** | (2006.01) |
| ***B65D 41/04*** | (2006.01) |
| ***B65D 51/24*** | (2006.01) |
| *B65D 81/36* | (2006.01) |

(52) U.S. Cl.
CPC ..... *B65D 41/04* (2013.01); *B65D 21/0204* (2013.01); *B65D 51/24* (2013.01); *B65D 81/361* (2013.01)

(58) Field of Classification Search
CPC .... B65D 41/04; B65D 21/0204; B65D 51/24; B65D 81/361
USPC ..... 206/508
See application file for complete search history.

(56) References Cited

FOREIGN PATENT DOCUMENTS

| | | | |
|---|---|---|---|
| CN | 202346087 | U | 7/2012 |
| CN | 205087350 | U | 3/2016 |
| CN | 205366461 | U | 7/2016 |
| CN | 207292902 | U | 5/2018 |
| WO | 0168210 | A2 | 9/2001 |

*Primary Examiner* — Anthony D Stashick
*Assistant Examiner* — Pierce T Dunwoody
(74) *Attorney, Agent, or Firm* — Bayramoglu Law Offices LLC

(57) ABSTRACT

A container lid includes a lid for sealing a filling tube connected to an external environment. A bottom end of the lid is provided with a hollow inner cavity, and an inner side wall of the hollow inner cavity is provided with a thread. An upper end of the lid is provided with at least two sliding grooves. The present invention can be used for sealing container filling tubes. Moreover, the lids of the present invention can be assembled to form any combined shapes, thereby reducing garbage pollution and promoting environmental protection.

17 Claims, 7 Drawing Sheets

CONTAINER LID

CROSS REFERENCE TO THE RELATED APPLICATIONS

This application is the national phase entry of International Application No. PCT/CN2018/109024, filed on Sep. 30, 2018, which is based upon and claims priority to Chinese Patent Application No. 201810973938.X, filed on Aug. 24, 2018, the entire contents of which are incorporated herein by reference.

TECHNICAL FIELD

The present invention relates to a lid for sealing a filling tube connected to an external environment, and particular relates to a container lid.

BACKGROUND

At present, a sealed container for storing materials is usually provided with a filling tube in order to facilitate the filling and pouring of materials. If the sealed container is a flexible package for packaging liquid foods such as juice, milk, sucking jelly and the like, the filling tube can also be used as a drinking straw. In addition, in order to facilitate the storage of the materials, a sealing lid is generally arranged at an opening of the filling tube. An outer wall of the filling tube is provided with a thread, and an inner wall of the sealing lid is also provided with a thread. Through a threaded connection between the sealing lid and the filling tube, the sealing lid is installed on the opening of the filling tube, thereby effectively protecting the materials in the container.

SUMMARY

The existing lids generally only have the function of sealing an opening of a container such as a bottle or a package. Once the materials contained in the container are used up, the container such as the bottle and the package may be recycled and reused due to a large size and a high value. However, a value of the lid is very small, so the lid is often discarded at will, and basically loses a value for secondary use, resulting in a lot of waste. Moreover, throwing the lid away randomly is prone to causing waste and damage to the environment.

The objective of the present invention is to provide a container lid. According to a structural design of the container lid, the container lid can be used to seal the container filling tube. Moreover, various container lids can be further assembled to form various shapes, thereby improving the usage and interest of the lid, and facilitating the collection of the lid.

In order to achieve the above objective, the technical solution of the present invention is as follows. A container lid includes a lid for sealing a filling tube connected to an external environment. A bottom end of the lid is provided with a hollow inner cavity, and an inner side wall of the hollow inner cavity is provided with a thread, An upper end of the lid is provided with at least two sliding grooves.

Further, an outer side wall of the lid is provided with at least one first insertion unit and at least one second insertion unit.

Further, the first unit includes an insert block, and the second insertion unit includes an insert groove.

Further, both sides of the insert block connected to the outer side wall of the lid are provided with rounded corners, and two sides of the insert groove connected to the outer side wall of the lid are provided with rounded corners. The rounded corners of the insert block are rounded corners of the outer side wall concaving inwards, and the rounded corners of the insert groove are rounded corners of the outer side wall protruding outwards.

Further, an upper end side of the insert block is provided with a protrusion.

Further, the bottom end of the lid is provided with at least one insert bar and at least one insert hole.

Further, each sliding groove has a circular arc shape, the sliding grooves are evenly disposed on the upper end of the lid, and a fixed groove is disposed between adjacent sliding grooves.

Further, fixed grooves are symmetrical with each other, and a length of the insert block is a half of a length of the symmetric fixed groove.

Further, at least two reinforcing ribs are disposed between an outer side wall of the inner cavity and an inner side wall of the lid, and the insert bar and the insert hole are disposed on the reinforcing rib in a staggered manner.

Further, the sliding groove has an amplitude of 20°-25°.

By implementing the above technical solution, the present invention can be used for sealing container filling tubes. Moreover, the lids of the present invention can be assembled into any combined shape, thereby increasing interest, reducing garbage pollution, and promoting environmental protection.

DESCRIPTION OF DESIGNATORS OF MAIN COMPONENTS

1. lid; 11. insert block; 12. insert groove; 13. sliding groove; 14. fixed groove; 2. inner cavity; 21. thread; 22. reinforcing rib; 23, insert bar; 24, insert hole.

DETAILED DESCRIPTION OF THE EMBODIMENTS

In order to make the purpose, technical scheme and advantages of the present invention clearer, the present invention will be further described in detail below with reference to the drawings and embodiments.

Embodiment 1

Figure 1:
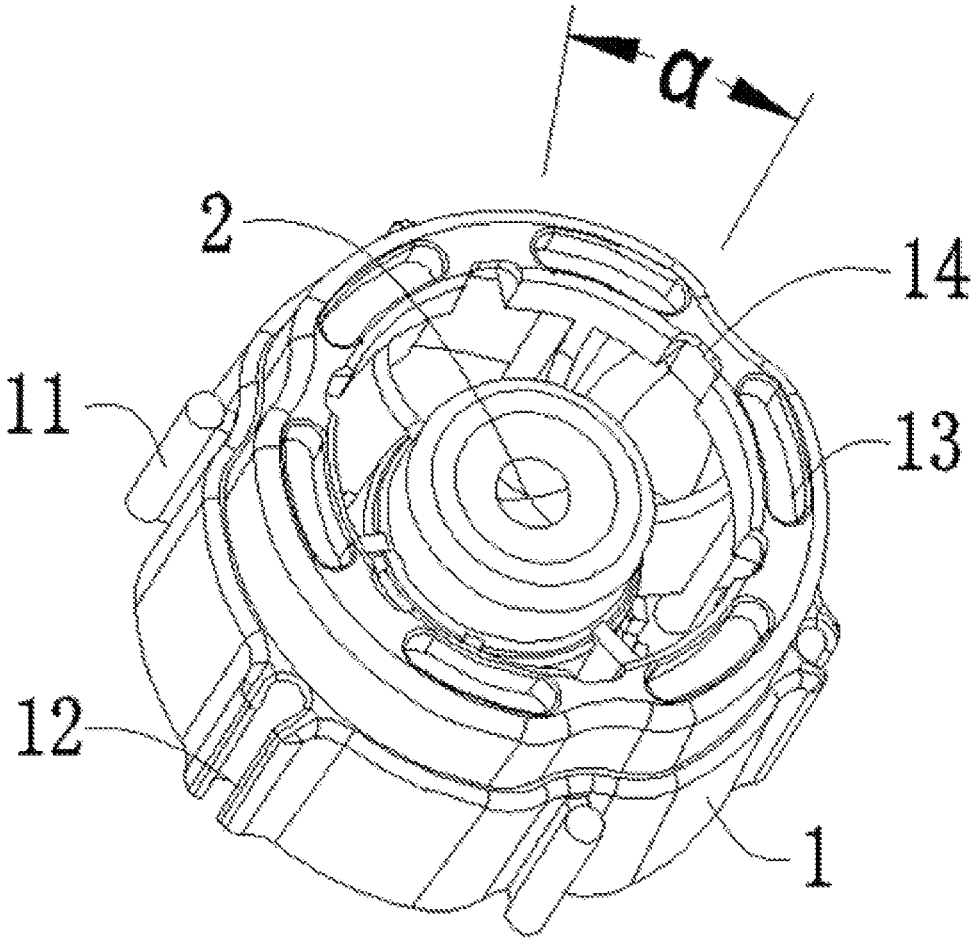
FIG. 1 is a schematic diagram of an overall structure of the present invention.
Figure 2:
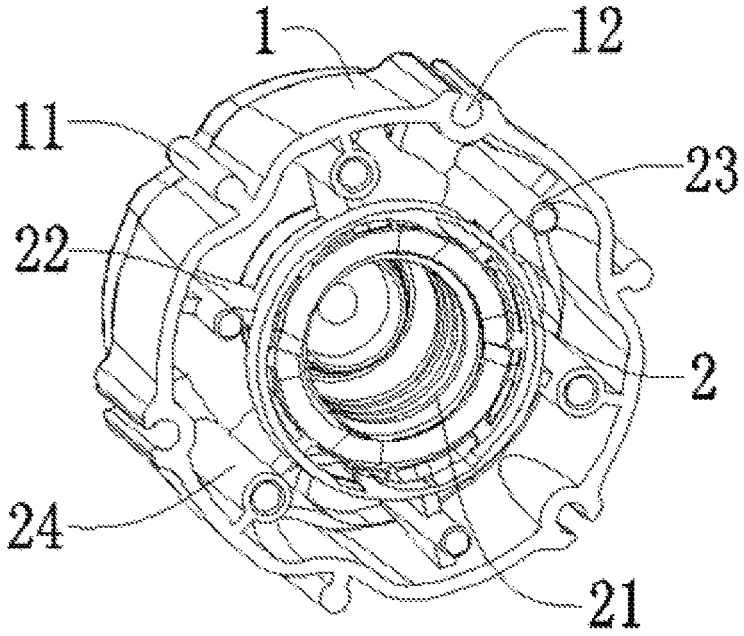
FIG. 2 is a schematic diagram of an overall structure of the present invention from another direction.
Figure 3:
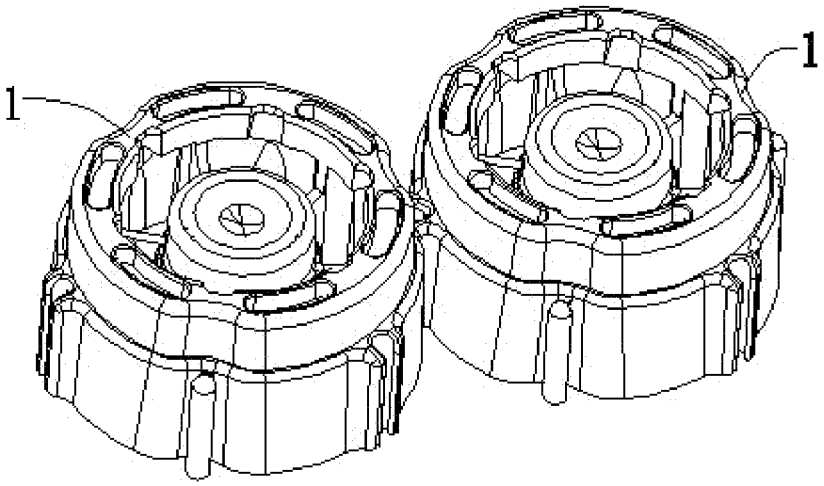
FIG. 3 is a first use state reference diagram of the preferred embodiment as shown in FIG. 1.
Figure 4:
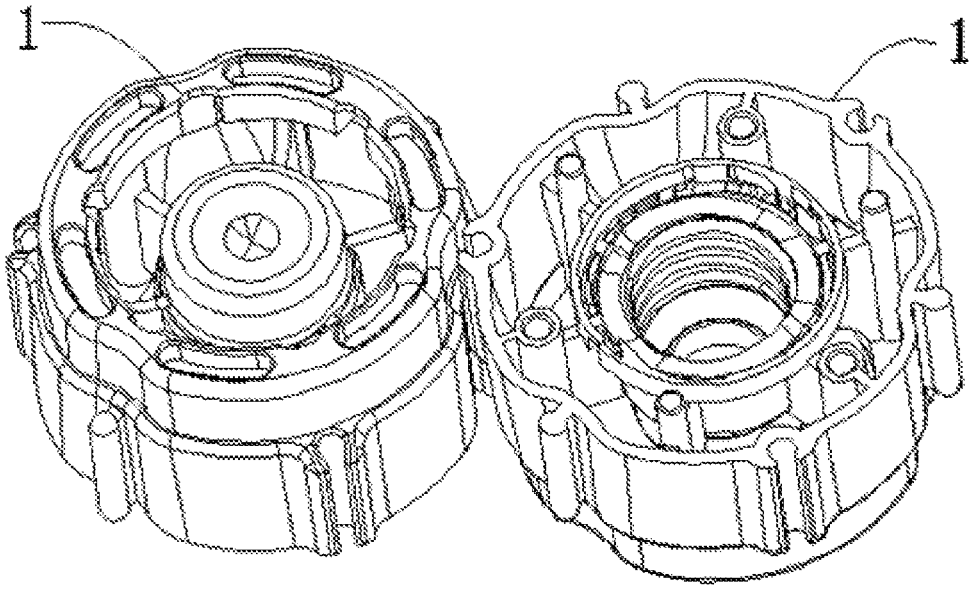
FIG. 4 is a second use state reference diagram of the preferred embodiment as shown in FIG. 1.
Figure 5:
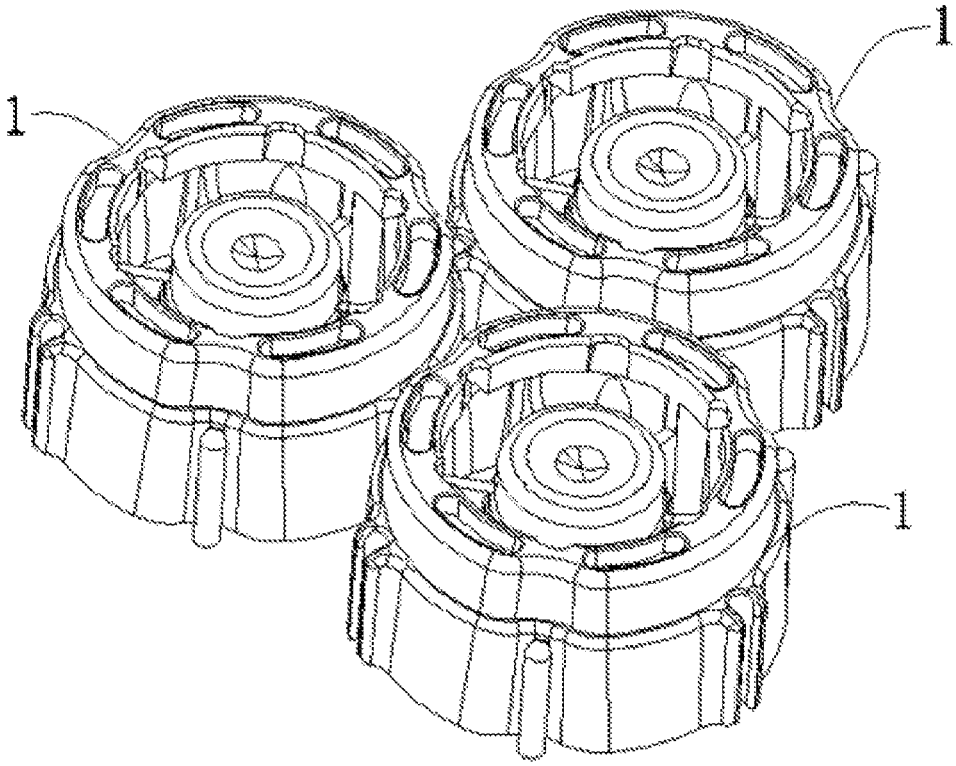
FIG. 5 is a third use state reference diagram of the preferred embodiment as shown in FIG. 1.
Figure 6:
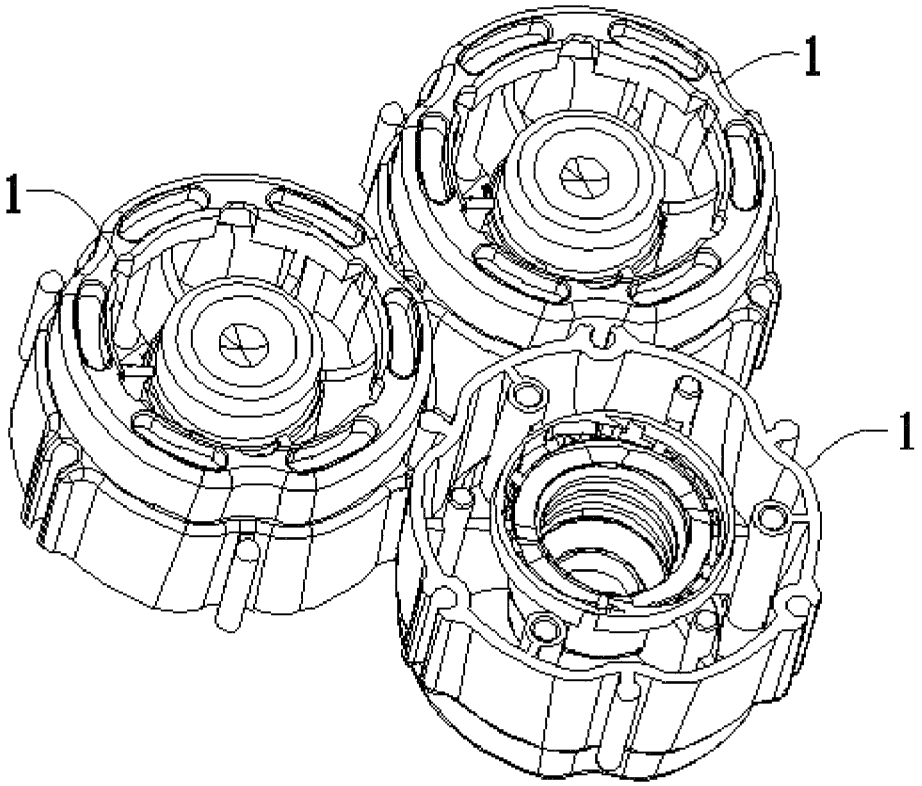
FIG. 6 is a fourth use state reference diagram of the preferred embodiment as shown in FIG. 1.
Figure 7:
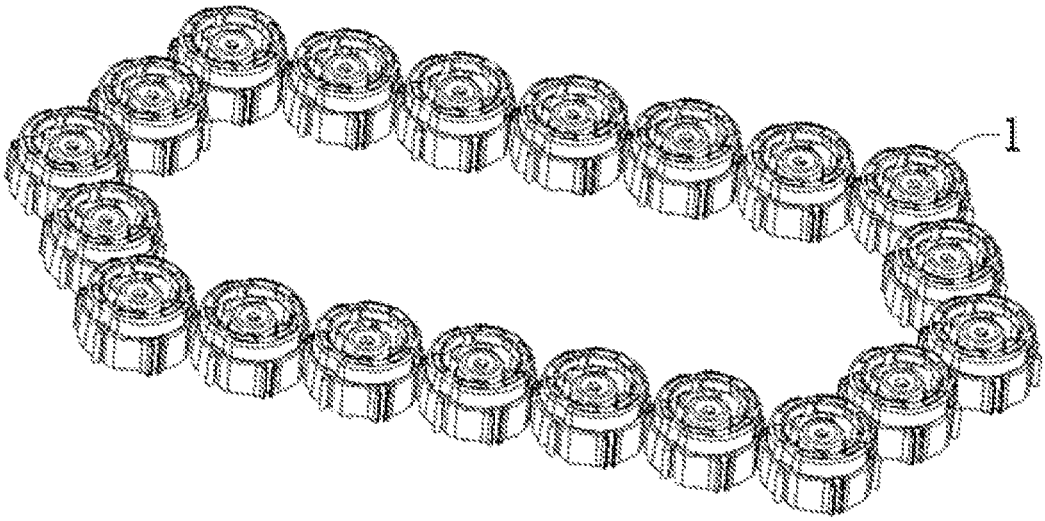
FIG. 7 is a fifth use state reference diagram of the preferred embodiment as shown in FIG. 1.
Figure 8:
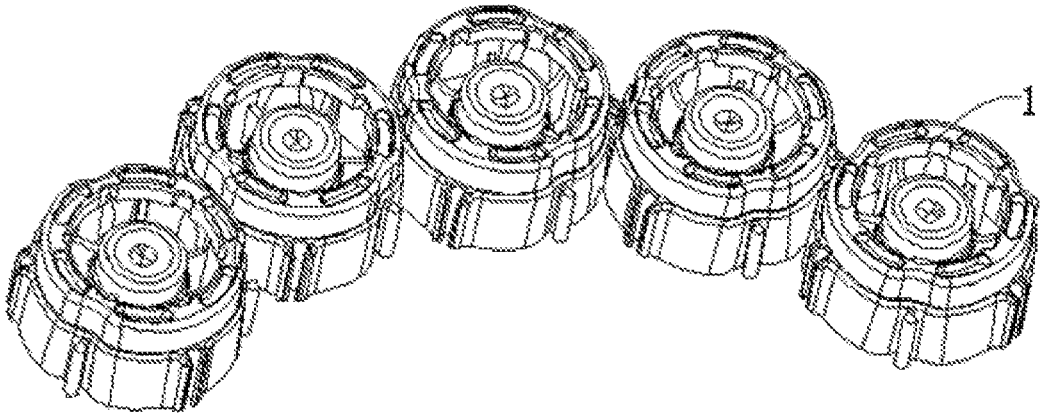
FIG. 8 is a sixth use state reference diagram of the preferred embodiment as shown in FIG. 1.
Figure 9:
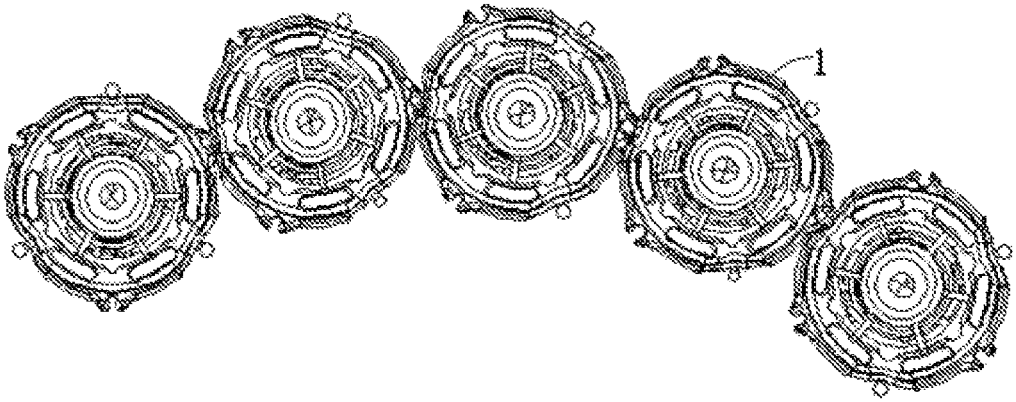
FIG. 9 is a top view of the sixth use state reference diagram of the preferred embodiment as shown in FIG. 1.

As shown in FIGS. 1-2, a container lid is disclosed in the present embodiment. The container lid includes the lid 1 for sealing a filling tube connected to an external environment. A bottom end of the lid 1 is provided with the hollow inner cavity 2, and the thread 21 is provided on an inner side wall of the hollow inner cavity 2. An upper end of the lid 1 is evenly provided with six sliding grooves 13. Each sliding groove has a circular arc shape, and a rotation amplitude $\alpha$ of each sliding groove is 20° to 25°. The fixed groove 14 for fixing is disposed between the two adjacent sliding grooves 13. and the fixing grooves 14 are symmetrical to each other.

An outer side wall of the lid 1 is provided with three first insertion units and three second insertion units. Each first insertion unit includes the insert block 11, and each second insertion unit includes the insert groove 12. The insert blocks 11 and the insert grooves 12 are evenly provided on the outer side wall of the lid 1 in a staggered manner. An upper end of the insert block 11 is provided with a protrusion, and a length of the insert block 11 is a half of a length of the symmetric fixing groove 14. Two sides of the insertion block 11 connected to the outer side wall of the lid 1 are provided with rounded corners, and two sides of the insert groove 12 connected to the outer side wall of the lid 1 are also provided with rounded corners. The rounded corners of the insert block 11 are rounded corners of the outer side wall concaving inwards, and the rounded corners of the insert groove 12 are rounded corners of the outer side wall protruding outwards.

Six of the reinforcing ribs 22 are uniformly disposed between an outer side wall of the inner cavity 2 and an inner side wall of the lid 1, The reinforcing ribs 22 are respectively provided with six of the insert bars 23 and six of the insert holes 24, and the insert bars 23 and the insert holes 24 are disposed on the reinforcing ribs 22 in a staggered manner.

The present invention further includes the following embodiments.

Embodiment 2

As shown in FIGS. 3-9, on the basis of the first embodiment, the insertion block 11 of the first lid 1 is inserted into the insert groove 12 of the second lid 1, so that the first lid 1 is connected to the second lid 1. Two sides of the insert block 11 connected to the outer side wall of the first lid 1 and two sides of the insert groove 12 connected to the outer side wall of the second lid 1 are respectively provided with rounded corners, thereby the first lid 1 and the second lid 1 can rotate along the rounded corners by a predetermined angle. The two lids 1 may be connected to each other in a same direction or a reverse direction as needed, and an unlimited number of lids may be connected according to actual demand.

Embodiment 3

Figure 10:
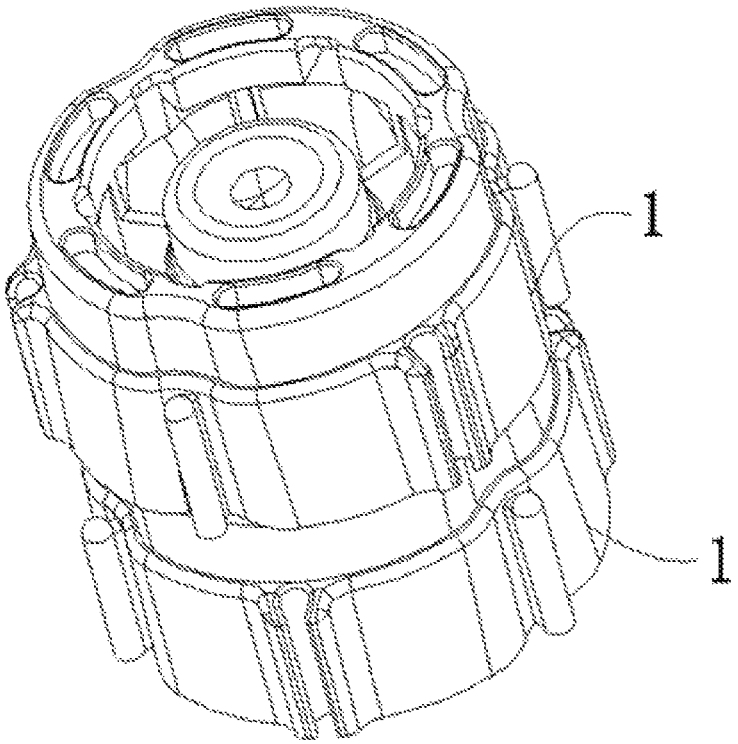
FIG. 10 is a seventh use state reference diagram of the preferred embodiment as shown in FIG. 1.
Figure 11:
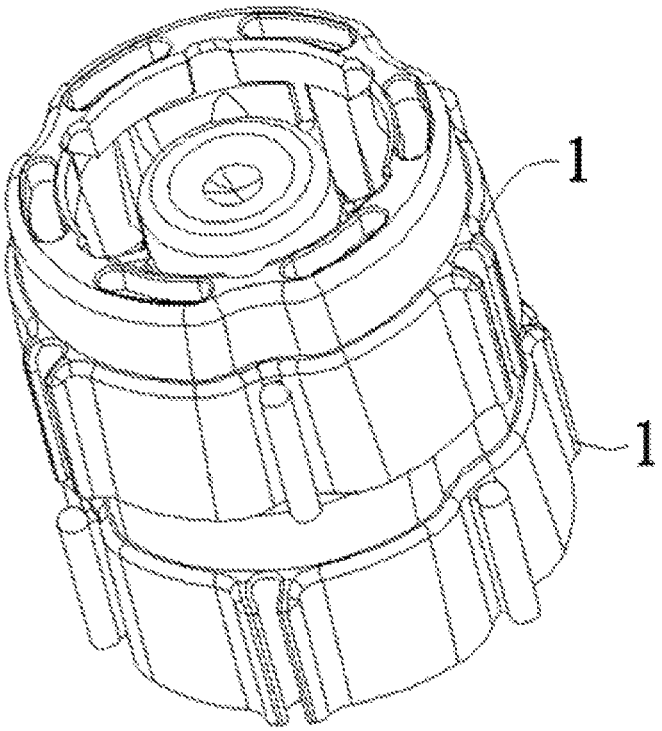
FIG. 11 is an eighth use state reference diagram of the preferred embodiment as shown in FIG. 1.

As shown in FIGS. 10-11, on the basis of the first embodiment, the insert bar 23 of the first lid 1 is inserted into the sliding groove 13 of the second lid 1, and the insert bar 23 of the first lid 1 may slide along an arc in the sliding groove 13.

Embodiment 4

Figure 12:
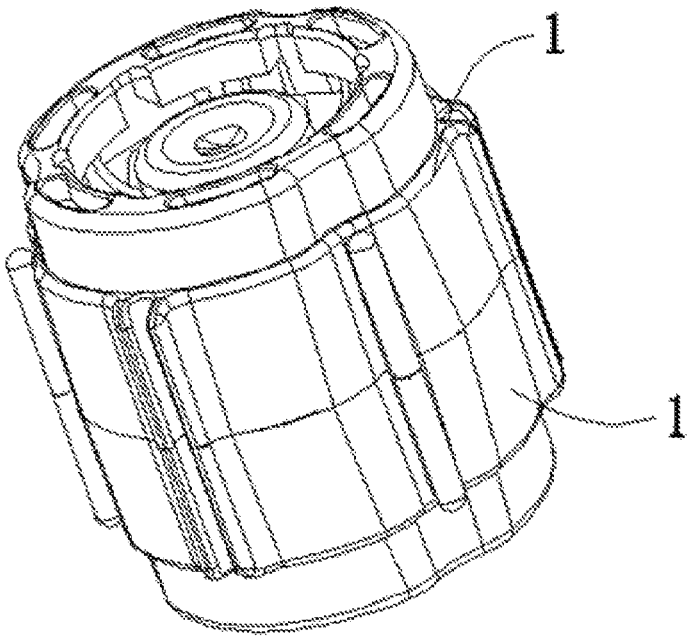
FIG. 12 is a ninth use state reference diagram of the preferred embodiment as shown in FIG. 1.

As shown in FIG. 12, on the basis of the first embodiment, the insert bar 23 of the first lid 1 is inserted into the insert hole 24 of the second lid 1, thereby the first lid 1 is connected to the second lid 2.

Embodiment 5

Figure 13:
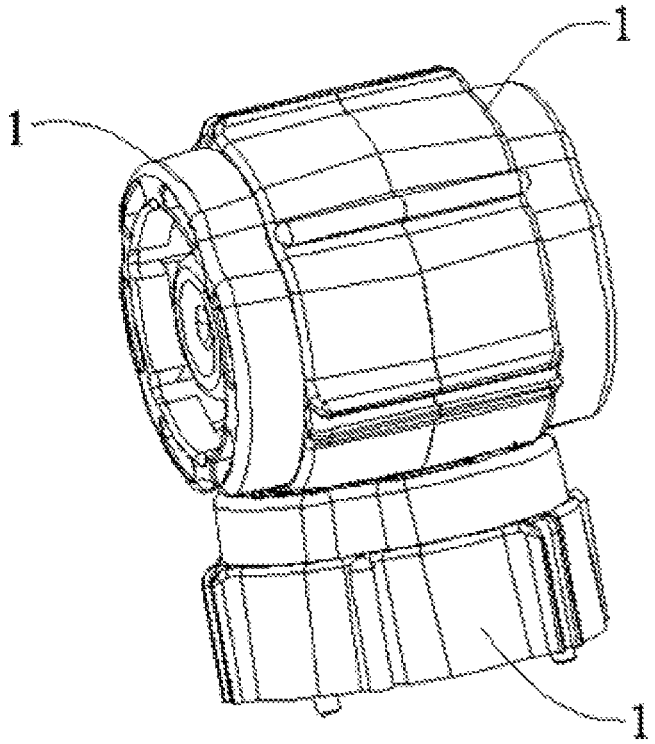
FIG. 13 is a tenth use state reference diagram of the preferred embodiment as shown in FIG. 1.

As shown in FIG. 13, on the basis of the fourth embodiment, after the first lid 1 is connected to the second lid 1, the protrusions at both ends of the insert blocks 11 of the two lids are used for fixing in the fixed groove 14 at an upper end of the third lid 1.

INDUSTRIAL APPLICABILITY

In summary, the present invention can be used for sealing container filling tubes. Moreover, the lids of the present invention can be assembled to form any combined shapes, thereby reducing garbage pollution and promoting environmental protection.

The above description shows only preferred embodiments of the present invention, but the scope of the present invention is not limited thereto. Any modification or substitution that can be easily thought of by those skilled in the art within the technical scope disclosed by the present invention shall be covered within the protective scope of the present invention.

What is claimed is:

1. A container lid, comprising: a lid for sealing a filling tube connected to an external environment; wherein a bottom end of the lid is provided with a hollow inner cavity, and an inner side wall of the hollow inner cavity is provided with a thread; and an upper end of the lid is provided with at least two sliding grooves;

wherein the bottom end of the lid is provided with at least one insert bar and at least one insert hole, and a rotation amplitude of each of the sliding grooves is 20° to 25°.

2. The container lid according to claim 1, wherein an outer side wall of the lid is provided with at least one first insertion unit and at least one second insertion unit.

3. The container lid according to claim 2, wherein each of the first insertion unit comprises an insert block, and each of the second insertion unit comprises an insert groove.

4. The container lid according to claim 3, wherein two sides of the insert block connected to the outer side wall of the lid are provided with first rounded corners, and two sides of the insert groove connected to the outer side wall of the lid are provided with second rounded corners.

5. The container lid according to claim 4, wherein the first rounded corners are rounded corners of the outer side wall of the lid concaving inwards, and the second rounded corners are rounded corners of the outer side wall of the lid protruding outwards.

6. The container lid according to claim 4, wherein at least two reinforcing ribs are provided between an outer side wall of the hollow inner cavity and an inner side wall of the lid.

7. The container lid according to claim 3, wherein an upper end side of the insert block is provided with a protrusion.

8. The container lid according to claim 7, wherein at least two reinforcing ribs are provided between an outer side wall of the hollow inner cavity and an inner side wall of the lid.

9. The container lid according to claim 3, wherein each of the sliding grooves has a circular arc shape, and the sliding grooves are evenly disposed on the upper end of the lid, and a fixed groove is disposed between adjacent sliding grooves of the sliding grooves.

10. The container lid according to claim 9, wherein when a number of the sliding grooves is equal to or greater than three, two or more of the fixed grooves are symmetrical to each other.

11. The container lid according to claim 10, wherein a length of the insert block is a half of a length of the fixed groove.

12. The container lid according to claim 10, wherein at least two reinforcing ribs are provided between an outer side wall of the hollow inner cavity and an inner side wall of the lid.

13. The container lid according to claim 9, wherein at least two reinforcing ribs are provided between an outer side wall of the hollow inner cavity and an inner side wall of the lid.

14. The container lid according to claim 3, wherein at least two reinforcing ribs are provided between an outer side wall of the hollow inner cavity and an inner side wall of the lid.

15. The container lid according to claim 2, wherein at least two reinforcing ribs are provided between an outer side wall of the hollow inner cavity and an inner side wall of the lid.

16. The container lid according to claim 1, wherein at least two reinforcing ribs are provided between an outer side wall of the hollow inner cavity and an inner side wall of the lid.

17. The container lid according to claim 16, wherein a plurality of the insert bars and a plurality of the insert holes are provided on the reinforcing ribs in a staggered manner.

* * * * *